US005479352A

United States Patent [19]

Smith

[11] Patent Number: 5,479,352

[45] Date of Patent: Dec. 26, 1995

[54] SYSTEM FOR ACCURATELY POSITIONING OPERATIONS ON CONVEYED PRODUCTS

[75] Inventor: Wayne T. Smith, San Rafael, Calif.

[73] Assignee: Golden Gate Microsystems, Inc., San Rafael, Calif.

[21] Appl. No.: 330,206

[22] Filed: Oct. 27, 1994

[51] Int. Cl.[6] ..... G06F 19/00

[52] U.S. Cl. ..... 364/469; 118/682; 118/686; 118/697; 364/471

[58] Field of Search ..... 364/469, 471, 364/478, 167.01, 479; 118/669, 674, 682, 686, 697, 702, 712, 325; 156/64, 367, 351, 356, 368, 378; 271/202, 203; 198/341

[56] References Cited

U.S. PATENT DOCUMENTS

| | | | |
|---|---|---|---|
| 4,262,582 | 4/1981 | Sugimoto et al. | 364/471 X |
| 5,027,293 | 6/1991 | Pung et al. | 364/471 X |
| 5,308,398 | 5/1994 | Ottl et al. | 364/469 X |
| 5,325,306 | 6/1994 | Adachi et al. | 364/471 |

*Primary Examiner*—Joseph Ruggiero
*Attorney, Agent, or Firm*—Thomas M. Freiburger

[57] ABSTRACT

A system for accurately controlling the start and stop positions for operations on conveyor-moved products, such as for applying glue lines, perforations or slits on sheets of paper, uses product position rather than timing to accurately control "on" and "off" operation positions on the product. The entry of a sheet of paper, for example, onto the conveyor path is noted by detecting the leading edge of the paper moving past an optical sensor. The location of the sheet is always known in a computer, due to conveyor position information continually fed to the computer. Distances which will be involved in the compensation times for the operating devices (e.g. glue heads) are calculated so that the gluing or other operation will be accurately located, but because the speed of the conveyor may vary, the "on" and "off" compensation distances are not calculated until just before the paper reaches the glue head, with current speed determined and applied to the known compensation times to calculate compensation distances.

14 Claims, 7 Drawing Sheets

SYSTEM FOR ACCURATELY POSITIONING OPERATIONS ON CONVEYED PRODUCTS

BACKGROUND OF THE INVENTION

The invention is in the field of timing of operations of moving workpieces in an assembly line process. In a specific embodiment the invention is concerned with operations performed on sheets of paper, such as applying dots or lines of glue, perforations, or slits to the paper. In accordance with the invention the control of the positioning of these operations is made more precise and waste of initial sheets is avoided.

In manufacturing operations on moving workpieces carried on a conveyor, it is important that the operation be carried out at the proper location on the conveyed product, and this can be affected by compensation times or lag times of the operating devices. Such a compensation time is the delay between the time an electrical pulse is sent to the operating device and the time the operation actually takes place, and similarly, the delay to discontinue an action such as applying a slit or glue line. In many systems the timing of the operation, to allow for the compensation time, has simply assumed a fixed time duration between a sheet trip point and the operation of the device, which assumes a constant speed of the conveyor. More accurate encoder-driven systems base operation of the device as a function of position, but still base the lead time for operations on a selected conveyor speed. If the conveyor speed changes in such prior systems, or if an interruption occurs, the resulting position on the workpiece where the operation actually takes place will be shifted. If the operator decides to select a different conveyor speed, he will have to change the lead times for turning "on" and "off" each operating device.

One example of such a process is the performing of operations on sheets of paper. In application of glue lines, for example, the conveyor moves quite fast and a change in speed can cause considerable inaccuracy in the application of the glue if compensation time is applied based on an assumed speed. The results are adversely affected as well simply by relying on timing for dispensing the glue, assuming the paper will be at certain positions at certain times based on assumed conveyor speed.

Typically several settable potentiometers have been used in the operations of glue-applying machines, with these potentiometers being settable by the operator to allow for the compensation time of each glue head. However, the operator has typically had to discard several sheets, because he had to make trial and error runs of several sheets in order to correctly "tune" the potentiometers to apply and cut off electrical pulses at precisely the right times to achieve the glue pattern in the desired position. Also, in the actual run, once the timing of the glue heads is tuned, one or several more sheets may need to be thrown away because the conveyor is not yet up to ideal speed, affecting the location of the glue application.

As such, current glue dispensing techniques and systems typically assume that the conveyor, and therefore the passage of the paper or other workpiece, maintains a constant speed during the process thereby resulting in both product and time losses.

SUMMARY OF THE INVENTION

The invention described herein overcomes problems of proper tuning of an operation wherein glue (or another operation) is applied to sheets of paper, primarily by using distance or position rather than timing, to govern the activation of glue heads subject to compensation times. The speed of operation of the conveyor can vary quite widely with the system of the invention, without resulting in significant errors in location of the glue on the paper.

Similarly, for other operations performed by an operating device on products moving on a conveyor, the system of the invention assures accuracy and avoids extensive setup time and the use of trial and error in the setup.

In accordance with the present invention, a system is provided for accurately controlling the start and stop positions for operations on conveyor-moved products, operations such as described above. The system uses product position rather than timing to accurately control "on" and "off" operation positions on the product. The entry of a sheet of paper, for example, onto the conveyor path is noted by detecting the leading edge of the paper moving past a sensor, which may be an optical sensor. A shaft encoder continually feeds conveyor position information to a computer, in which desired operation "on" and "off" positions have been prestored. Thus, once the sheet of paper has entered the path, its location is always known in the computer, assuming the paper moves with the conveyor. The computer calculates desired result positions for "on" and "off" for each cycle of operation to be performed on the paper. The operating devices, such as glue heads, have a known compensation time, i.e. a delay between the time a pulse is started to turn the glue head "on" and when glue actually begins to be dispensed, and a similar "off" compensation time. The distances which will be involved with such compensation times are calculated as a function of conveyor speed so that the gluing or other operation will be accurately located, but because the speed of the conveyor may vary, the "on" and "off" compensation distances are not calculated until just before the paper reaches the glue head, with current speed determined and applied to the known compensation times to calculate compensation distances. These distances are used to determine conveyor positions at which to turn the glue head (or other device) "on" and "off".

Thus, the above speed and compensation distance calculations are completed immediately before the workpiece reaches the operating device, so that the measured conveyor speed information is as current as possible, thereby most accurately timing the activation of the glue head or other device. In a preferred embodiment the calculations are made so as to be completed an approximate preselected distance from the first "action" position, i.e. position at which an electrical pulse should be sent to turn the operating device "on". Such distance in one preferred embodiment is determined through preliminary, quick calculations which are made well in advance of the paper's reaching the glue head. These preliminary calculations, including speed of the conveyor and a calculation of approximate "advance distance" in front of the glue head at which the compensation distances should be calculated, are made repeatedly, e.g. every 50 milliseconds. Thus, once a position sensor has determined that a sheet of paper is on the belt at a known position, preliminary calculations are repeatedly made. These calculations include the current speed of movement of the belt, multiplied by the sum of a known required computation time and the "on" compensation time of the glue head which the paper is approaching. A computation time of 400 microseconds in this particular embodiment represents the time required to make the calculations of the first "on" and "off" compensation distances along with action positions at which the first electrical pulse "on" and "off" should occur, for the programming and computer used. The preliminary calculation described above gives a rough advance distance at which the first "on" and "off" compensation distance calculations should begin. This is preferably multiplied by a safety factor of 2 in this embodiment, to allow for any speed increases of the belt and also to allow for the possible need for a preliminary brief pulsing opening or "tickle" of the glue head, as described below.

The paper continues in its path, with the above preliminary calculations repeatedly made. At a position where the computer determines that no more preliminary calculations can be made before the point is reached where the actual "on" and "off" compensation distances must be calculated, those compensation distance calculations are then commenced. In this way, it is assured that the "on" and "off" compensation distances are calculated at the last possible moment and position, so that the latest conveyor speed information is used.

Further, a problem with glue heads is that there will be an additional delay if the glue head has not cycled on and off for a predetermined period of time, such as about one-half second. This would cause a positioning error. To avoid this problem, in the event the predetermined time has elapsed without action, as defined by the computer, the glue head is cycled on for about 20% of its normal compensation time (then off again), a short distance before the glue head is reached by the paper. This causes only a partial opening of the glue dispenser (such that glue is not dispensed), loosening it such that glue will be dispensed in a regular and predictable manner during its subsequent repeated on/off operation. The pulsing action starts a bouncing effect in the glue dispensing head, thus assuring more consistent time delays to operation. The safety factor described above leaves sufficient advance distance for this brief pulsing of the glue head to be carried out.

It is therefore among the objects of the invention to achieve accuracy in the position of operations performed on products moved by a conveyor, making allowance for both the "on" and "off" compensation times for various operating devices, such as application of slits, perforations, dots or lines of glue on sheets of paper. The invention avoids the need for trial and error in setup and for rejection of products due to errors in operation positioning; it enables programming to be done by entering specific position values rather than on a trial and error basis. These and other objects, advantages and features of the invention will be apparent from the following description of a preferred embodiment, considered along with the accompanying drawings.

DESCRIPTION OF PREFERRED EMBODIMENTS

Figure 1:
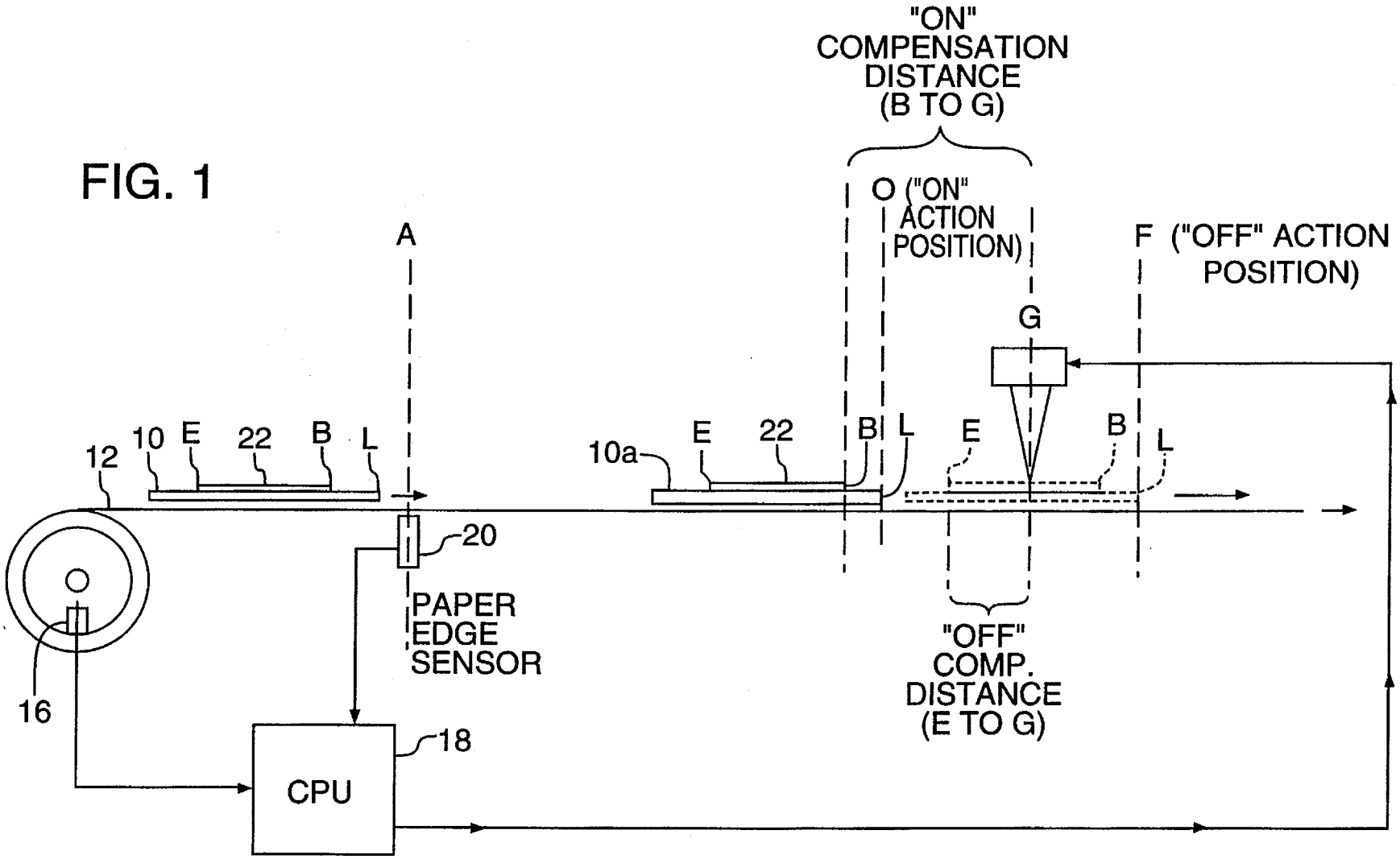
FIG. 1 is a schematic diagram indicating a process in accordance with the invention.

In FIG. 1 a product 10, which may be a sheet of paper, is moving on a conveyor 12 toward an operating device G, which may be a glue dispensing head. Although the system in this embodiment is described in terms of a preferred application to glue lines being applied to paper, the system and method are much more broadly applicable, as discussed above. The movement of the conveyor is measured by an encoder 16 (which may be a shaft encoder or other encoder sensing the belt) which transmits increments of motion and thus conveyor position information to a computer or CPU 18. A sensor 20, which may be an optical sensor, inductive, capacitative or other type of sensor, detects when the leading edge L of each paper reaches a position A at which the sensor 20 is located or aimed, and transmits the information to the CPU 18, as indicated. Each sheet of paper 10 has a point B (begin) at which the glue line 22 or other desired operation is to begin as applied by the glue head G (the position of the glue head is also identified as G). The sheet 10 also has a point E (end) at which the glue line 22 is to end, i.e. where the glue head G is to terminate its action. Several such glue lines or other operations may occur on a single sheet.

In the CPU 18 are prestored a number of data, among which are (a) information to relate the shaft encoder readings to the position and movement of the conveyor; (b) the distance from A to G, the sensor 20 to the glue head; (c) the "on" and "off" compensation times for the glue head G; (d) the desired locations B and E on the sheet of paper 10 at which the glue line or strip is to begin and end, relative to the leading edge L of the paper (there may be additional glue lines as well); and (e) a known duration of time required for the CPU's calculation of "on" and "off" compensation distances along with calculation of resulting action positions relative to the point G, where an electrical pulse to activate the glue head G should begin and end. These "on" and "off" action positions are shown in FIG. 1 at O and F. In a preferred embodiment, the CPU 18 repeatedly calculates speed of the conveyor as sheets of paper 10 and 10*a* progress toward the glue head G. As an example, a speed calculation may be performed about every 50 milliseconds, i.e. about 20 times per second.

Important objects of the system and method of the invention are (a) to accomplish triggering of an operation, e.g. the glue dispensing which involves a compensation time, by paper position rather than by timing, and (b) to accurately determine the proper triggering positions, in advance of the glue head, by calculating compensation distances based on conveyor speed as determined as recently as possible before the glue head actually must dispense glue onto the paper. Based on this latest up-to-date speed information just before the paper reaches the glue head, the computer calculates both "on" and "off" compensation distances for the first strip or dot of glue which is to be applied to the paper. In this way, all but the most insignificant glue positioning errors are avoided, since any conveyor speed changes which occur between the time of these calculations and the application of the glue to the paper will be relatively small.

As the sheet of paper 10 progresses along on the conveyor 12, its leading edge L reaches position A, at which the paper edge sensor 20 notes the presence of the paper and sends a signal to the CPU 18. The computer 18 has the information relating to the distance between A and G; the computer can thus use information from the encoder 16 to constantly monitor the position of the paper 10, via its leading edge L. The computer therefore constantly has the position of the paper's leading edge L and the remaining distance between L and G, the glue head.

As the sheet of paper 10 moves along, conveyor speed is repeatedly calculated as noted above. Along with each speed calculation there preferably is made another calculation. Prestored "on" compensation time for the glue head is added to the known time required for the computer 18 to make calculations of "on" and "off" compensation distance and resulting first "on" and "off" action positions. This known calculation time duration may be, for example, 400 microseconds. The sum of these two known times is multiplied by current conveyor speed, to determine an approximate "advance distance" in front of the glue head at which the calculations of compensation distance and action position should be made. To this calculated distance, a safety factor is applied, of 2 times (although other safety factors can be selected). This information is used to enable the calculation of compensation distances and "on" and "off" action positions at the last possible point before the first action position is actually reached, so that conveyor speed information will be as current and accurate as possible.

It is noted that, if the computer requires about 400 microseconds to make the compensation distance and action position calculations as described, the repeated preliminary speed and distance calculations just described will take a little more than half this time, i.e. just over 200 microseconds, because these are simpler and fewer calculations.

When the sheet of paper reaches a position such that, based on the last preliminary calculation of "advance distance", no further such calculation can be made before the paper (or point B) enters the "advance distance" as just calculated. The computer commences the compensation distance and action position calculations. Note that the "advance distance" ordinarily will extend farther back than point O in FIG. 1, more than twice the distance between O and G.

FIG. 1 shows a sheet of paper 10*a* on the conveyor, as its leading edge L reaches point O, a calculated first "on" action position. In accordance with the method described, the computer 18 has just completed the calculation of the location of point O, just before the paper reached this position. The calculations just completed have included calculation of an "on" compensation distance based on current speed, as well as preferably an "off" compensation distance based on current speed, for a first line or strip of glue to be applied to the paper. Using these compensation distances, the computer has in essence subtracted the calculated "on" compensation distance from the begin location B of the glue head, to arrive at a position in advance of G. This is shown in FIG. 1, with the resulting position being that position where the point B lies when the sheet 10*a* is at the position shown. To this position the computer adds back the distance between B and L on the paper, i.e. the distance between the begin point of the glue and the leading edge of the paper. This calculation results in the position O as shown in the drawing. Similarly, position F is also calculated in advance of the paper's reaching point O. The point F is determined by subtracting the "off" compensation distance from the position G, and by adding back the distance between E and L on the sheet of paper. This is shown with respect to a sheet of paper indicated in dashed lines in FIG. 1. The result of this calculation is the position F, which is shown beyond the point G. The paper shown in dashed lines has its leading edge L at the point F, so that the pulse activating the glue head would be turned off at this position of the paper, to terminate the glue strip 22.

In many applications, more than one similar operation will be performed on each product, and in the case of glue applied to paper, a series of dots or strips of glue may be applied on a sheet. The system preferably does not update the speed calculation for each separate glue strip to be applied, but instead relies on the latest speed calculation which was used for the "on" and "off" compensation distance calculations. These calculated compensation distances are used for each of the series of glue lines or strips on the particular sheet of paper. Only the action positions (O and F) will differ for each of the glue lines. Preferably, after the first calculation is made the computer 18 stores the "on" and "off" positions O and F, the first "on" position O being put into a compare register in the computer. A flag is set when the computer determines, via the shaft encoder 16, that the paper's leading edge L has reached this position. The first "off" position F has also been calculated, as noted above, in this calculation which occurs before the leading edge L of the paper reaches O. When the "on" action position O is actually reached by the leading edge L, the electrical pulse is of course initiated to turn the glue head "on", and at the same time, the computer shifts the "off" point F location to the compare register. The computer then proceeds to calculate the next "on" action position, for the second glue line to be applied to the paper. This is done using the compensation distances and the positions of the beginning and end points of the second glue line, relative to the leading edge of the paper. Thus, the computer stays ahead by one calculation, in addition to the calculation for the immediately succeeding action.

As noted above, as the paper 10 approaches the glue head, it may be determined that the glue head has not been opened for a preselected period of time (this may be about one-half second). If the glue head has not been opened for this long, it may not behave predictably, and there may be a further delay in initial opening of and dispensing of glue from the glue head. As described above, this may require an initial very brief pulsing of the glue head prior to the paper's reaching the position O in FIG. 1. Pre-calculated "advance distance" as described above is sufficiently long to allow a brief pulsing or "tickle" of the glue head, prior to the paper's reaching point O. Such a pre-pulsing of the glue head may be, as an example, only about 20% of the time duration of the "on" compensation time of the glue head. This pre-pulsing of the glue head is better understood with reference to FIG. 2.

Figure 2:
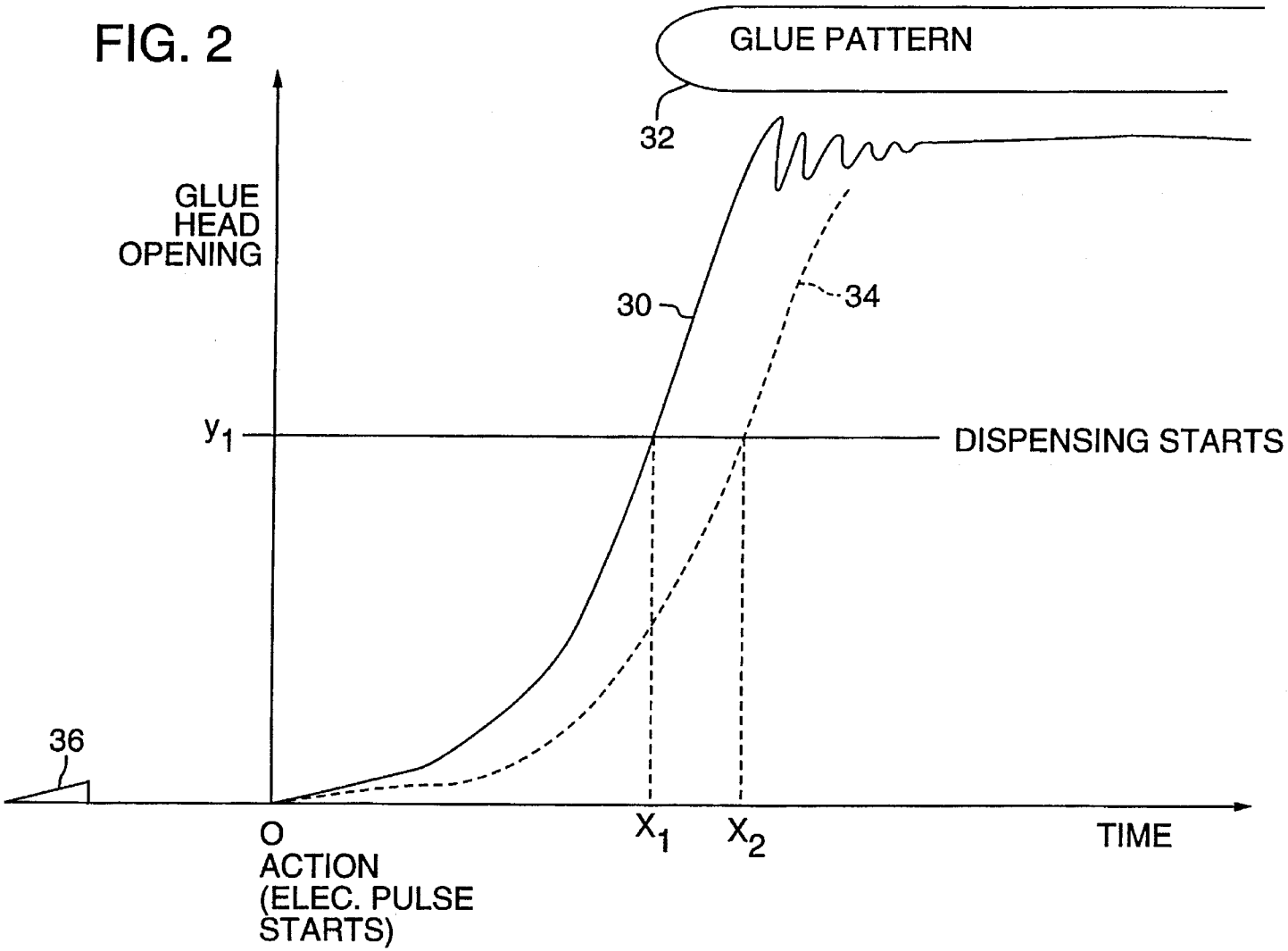
FIG. 2 is another diagram in the form of a graph illustrating the activation of a glue dispensing head in terms of dispenser opening versus time, and the use of a preliminary pulse to the glue head in order to prevent delay in dispensing beyond the normal compensation time.

In FIG. 2, the size of the opening of a glue head dispenser is plotted as a function of time. Line 30 shows a normal response curve when the glue head has not been closed or "off" for an inordinate period of time, and responds in a predictable and repeatable manner. Glue dispensing starts when the glue head has opened to the extent indicated at the level $Y_1$ on the graph, and as shown, this corresponds to a duration of time $X_1$. Thus, $X_1$ is the standard "on" compensation time for the glue head. As indicated on the curve 30, when the glue head reaches full opening, it tends to "bounce" or flutter for a short period of time before reaching stability at the fully open position. FIG. 2 also schematically shows a glue pattern 32 as produced by the glue head in its normal opening routine, beginning at a point at time $X_1$ and widening to the full pattern as the glue head opens further.

The dashed line curve 34 in FIG. 2 shows an example of a delayed opening of the glue head, an opening progression which is less predictable and repeatable, when the glue head has not been opened for some period of time such as one-half second. Again, glue dispensing starts at opening level $Y_1$, but this corresponds to an "on" compensation time $X_2$, which is longer and less repeatable than $X_1$.

To remedy the problem of the longer and less predictable compensation time $X_2$, the system is programmed to open the glue head for a very short preliminary opening, in the event the computer determines that the glue head has not been opened for the preselected period of time. This is shown at the short curve 36 in FIG. 2, where a brief "tickle" of the glue head is caused by a brief electrical pulse to the glue head. It has been found that a brief pulse having a duration of about 20% of the normal "on" compensation time ($X_1$), carried out just before the prescribed "action" point at time 0 on the graph, is sufficient to cause the glue head to follow the normal opening curve 30 and normal compensation time $X_1$ when the normal pulse is executed to open the glue head. This pre-pulse or tickle has the effect of loosening or priming the glue head, without dispensing any glue. As explained above, this brief pulse of the glue head can be performed before the sheet of paper 10*a* in FIG. 1 reaches the "on" action position O, since a sufficient safety factor is used in calculating the "advance distance" in which the computer should perform its compensation distance calculations for the operation. It is also noted that the computer 18 could perform this pre-pulse or "tickle" of the glue head during the calculations, since it can be keeping track of the opening and closing of the glue head independently, watching for an excessively long quiescent period.

Figure 3:
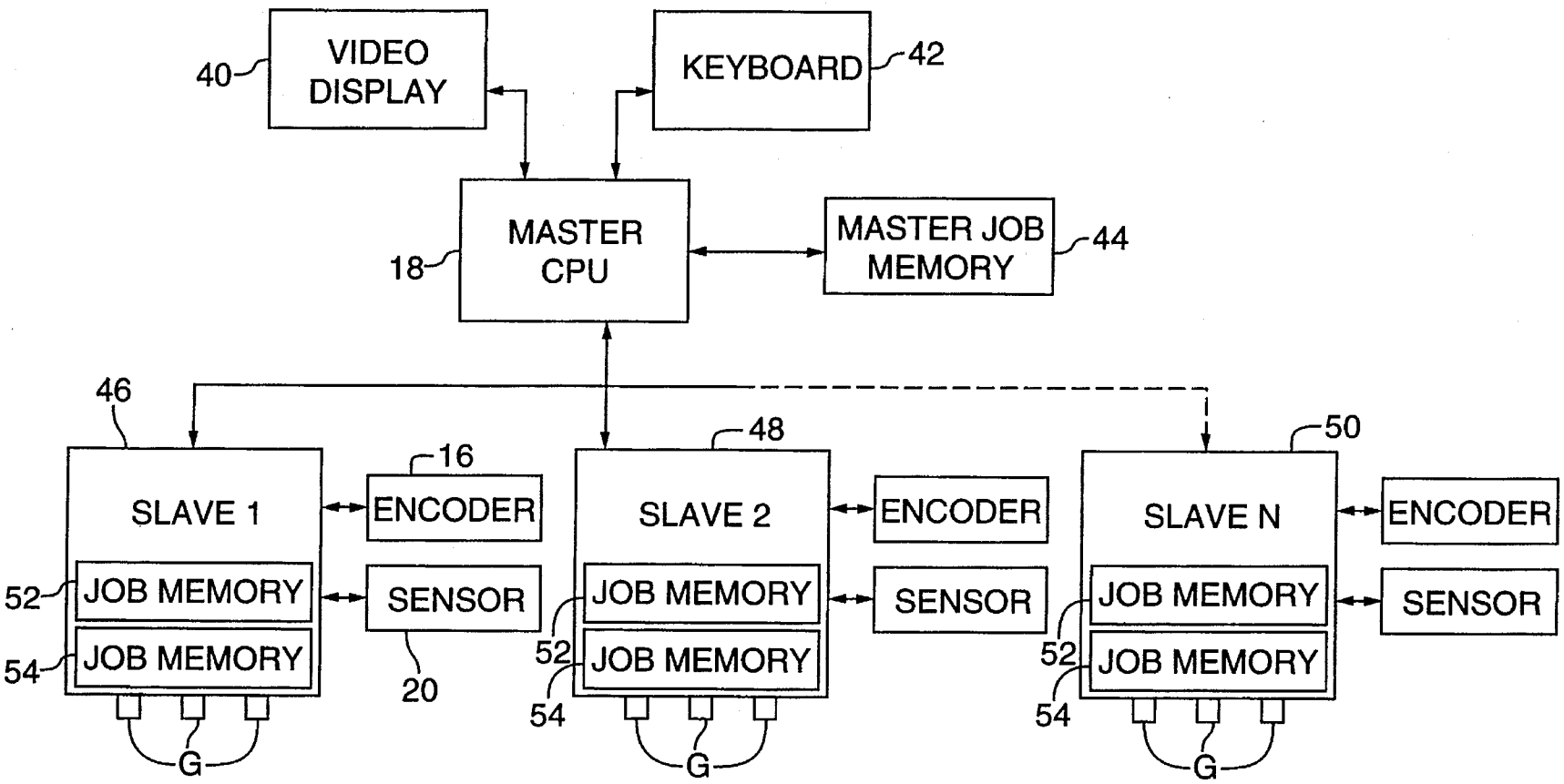
FIG. 3 is a system block diagram indicating the relationship of a master CPU to several slave units where operations occur.

FIG. 3 shows the master CPU 18 connected to a video display 40 and keyboard 42, thus allowing the operator to control and monitor the process. The master CPU 18 contains a master job memory 44 wherein are stored various pre-programmed jobs for current or future use.

The master CPU 18 drives a plurality of slaves, for example, slave 46, slave 48, and slave 50, which operate either on separate production lines or with some or all on the same production line.

As shown schematically in the drawing, each slave contains a plurality of job memories. Slave 1 (46), slave 2 (48) and slave N (50) are each shown as containing job memory 52 and job memory 54. A plurality of these job memories are employed within a single slave so that revised data can be downloaded but will not interrupt an operation in the middle of a sheet. The next sheet is treated according to new data if just downloaded and complete.

Each slave is also connected to the encoder 16 and the product sensor 20. The encoder 16 continually monitors changes in position of the conveyor. The product sensor 20 signals the slave when the leading edge of the paper has reached a predetermined point on the conveyor.

Each slave further contains a plurality of glue heads G for applying glue to the paper, one glue head G being shown in FIG. 1. It is noted that if more than one slave unit serves the same production line, so that conveyor speed is always common between the units, then an encoder and a sensor can be shared for those units.

Figure 4A:
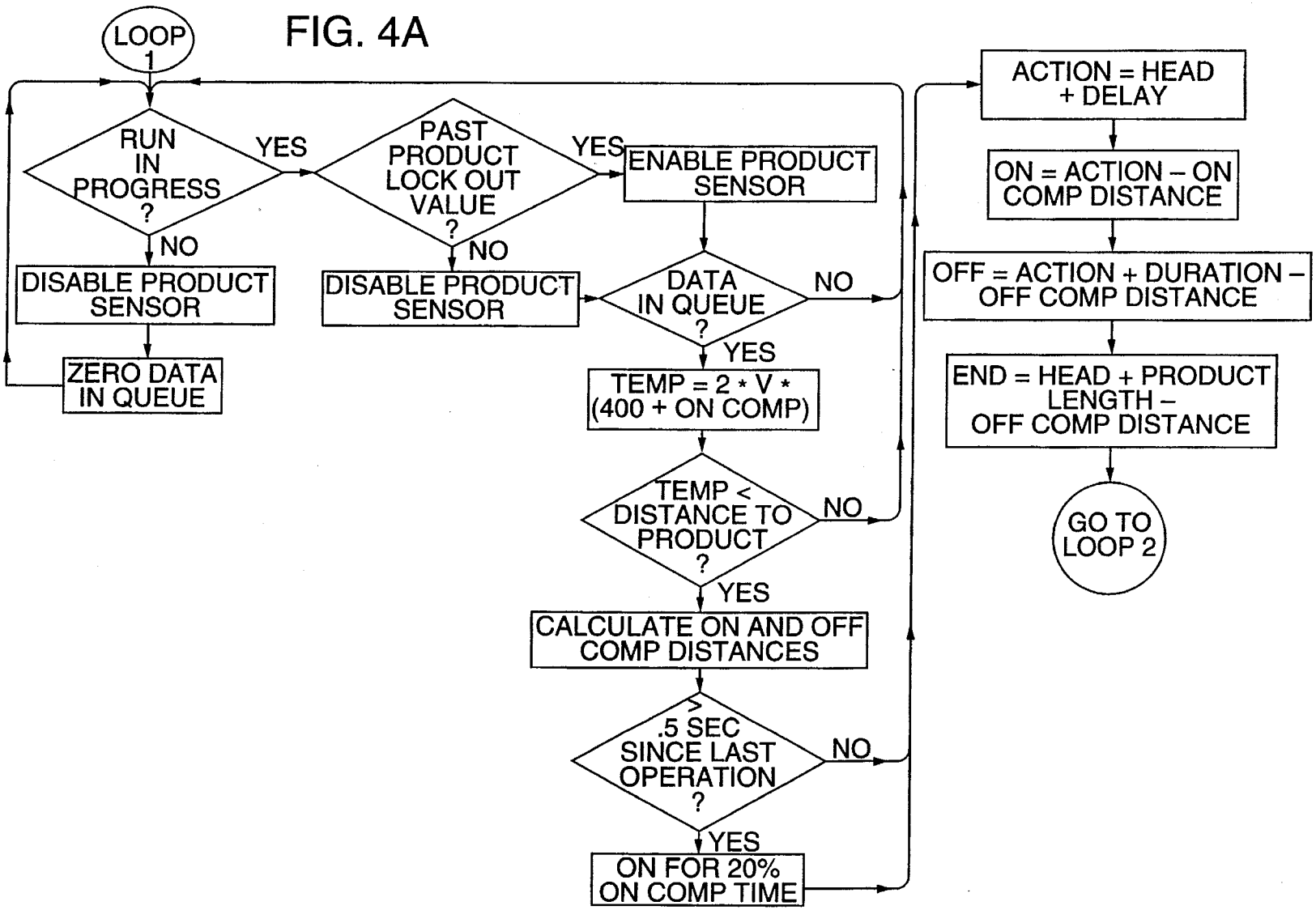
FIGS. 4A through 4D comprise flow charts for the system of the invention, with different drawings representing different loops of the process.

FIGS. 4A through 4D are a series of related flow charts representing the calculations and control loops used by the system of the invention. FIG. 4A shows the start up and steady state loop. A circular queue contains data for several sheets' positions that may be moving between the sensor and glue head simultaneously. If the queue is empty, steady state operation continues. When the queue is occupied, calculations are made for position of first glue, end of the glue, and end of the sheet. At the appropriate position final calculations are performed and loop 2 (FIG. 4B) is initiated.

Figure 4B:
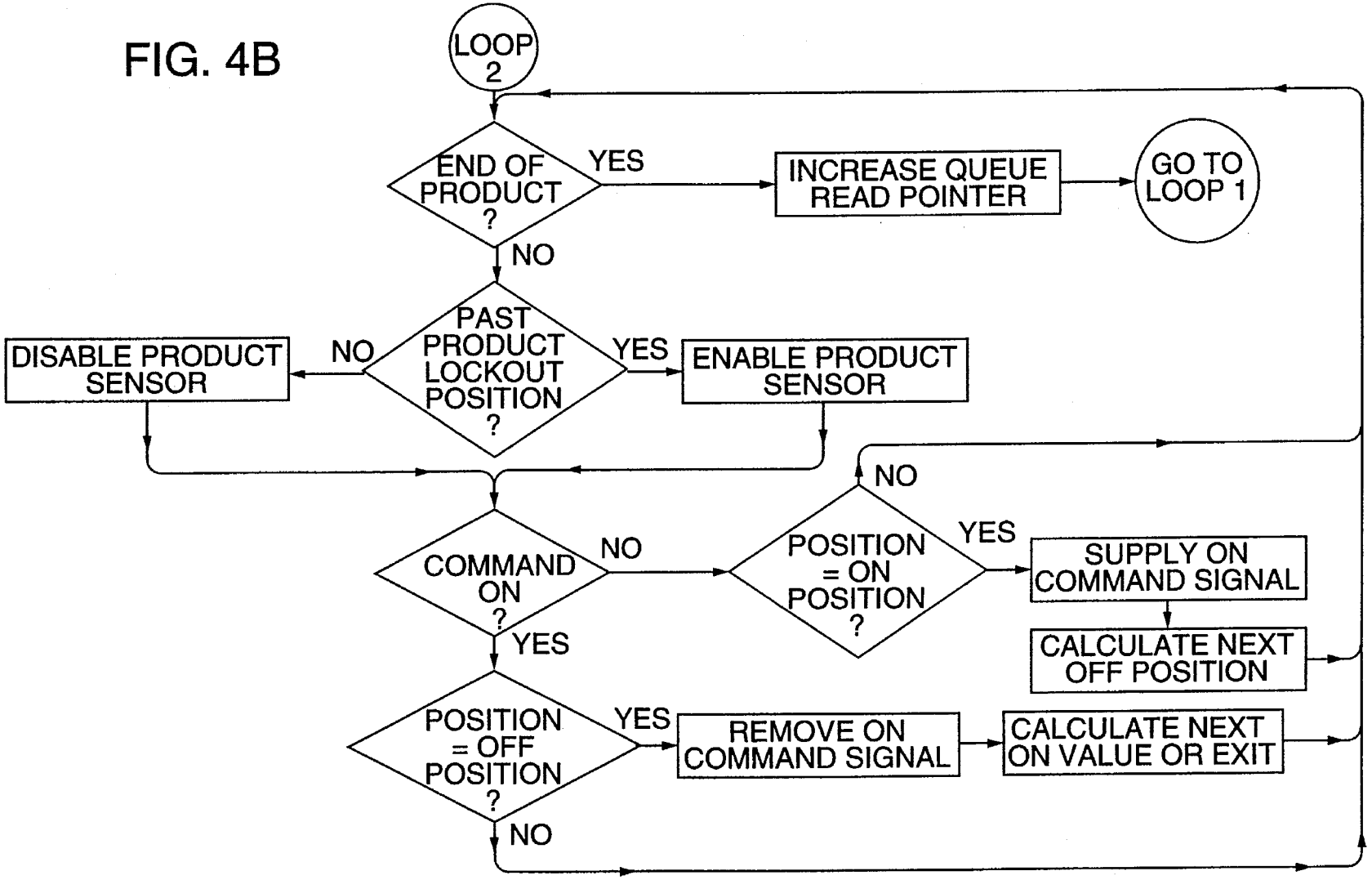

FIG. 4B shows the calculations for "on" and "off" actions based on the compensation distance and the event locations programmed for the sheet. When all actions are complete, loop 1 is initiated. Loop 2 allows for features such as stitched action if the system is so programmed by the operator.

Figure 4C:
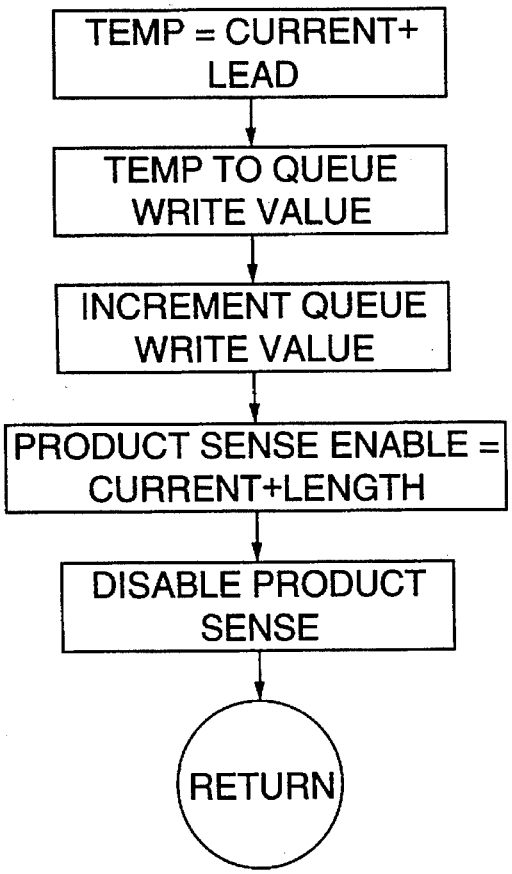

FIG. 4C shows the interrupt structure to ensure accurate product entry position storage for future sheet operation. Sheets are accepted only after the run command is issued. This interrupt can be disabled for a "lockout" distance to avoid false triggering on printed material (see Loop 1).

Figure 4D:
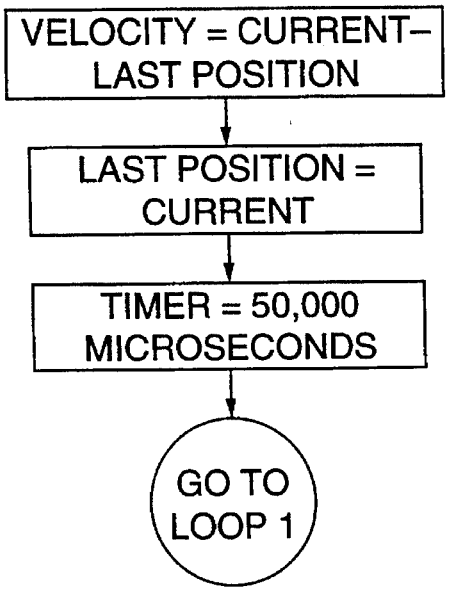

FIG. 4D shows the timer interrupt loop which is used to constantly recalculate the current velocity of the conveyor.

Figure 5:
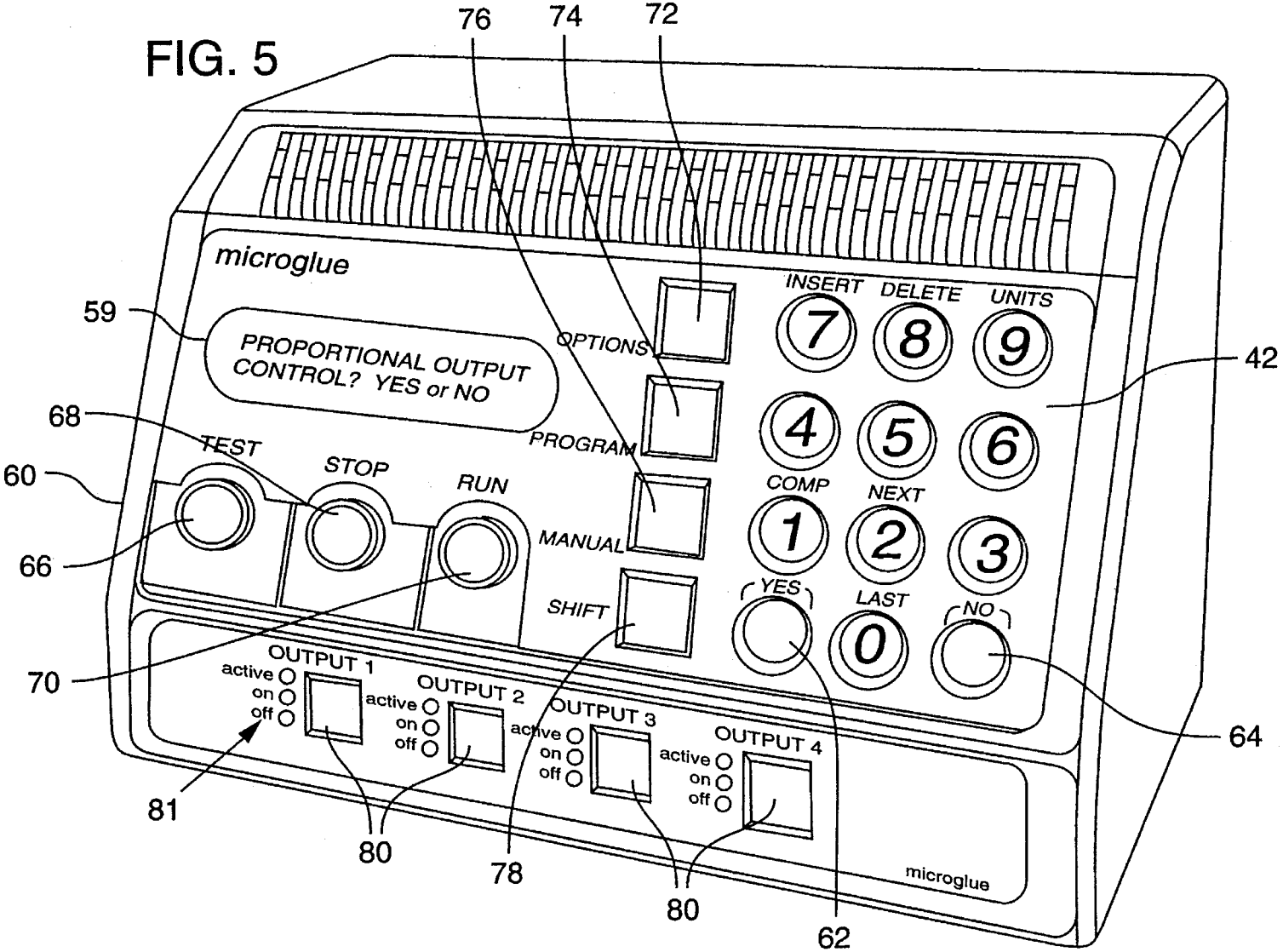
FIG. 5 is a perspective view showing an embodiment of a controlling unit for the system of the invention, showing the exterior and various manual inputs of the device.

FIG. 5 shows a control unit 60 which embodies the CPU 18 indicated in FIG. 1 and also in FIG. 3, with manual input keys and with a relatively small screen 59 to serve as the display 40 of FIG. 3. The screen 59 is shown bearing a prompt message for the operator. The control unit 60 includes a numerical keyboard 42, with various further keys 62, 64, 66, 68 and 70. Additional keys are "options" key 72, "program" key 74, "manual" key 76 and "shift" key 78 as shown in FIG. 5. Also shown are controls indicated as OUTPUT 1, OUTPUT 2, OUTPUT 3 and OUTPUT 4. These are included to provide for individual control of up to four different operating devices for a given slave unit. They include on/off toggle switches 80, which relate to each of the operating devices served by a given slave. Shown to the left of these toggle switches 80 are indicator lights 81. If more than one slave unit is to be served by the control unit 60, additional rows of toggle switches and indicator lights may be included, below the switches and indicators 80, 81 shown in FIG. 5. The basic unit illustrated in FIG. 5 will serve a single slave unit.

At power on, the master CPU polls the slaves to find out how many are installed. Values for compensation times, sensor lead distances, sensor input (multiple sensors may be used on a single system), and encoder input (several encoders may also be used) are stored in a configuration file accessed from the OPTIONS key 72. Once these values are assigned, they are only changed if device assignments or locations are altered. The operator presses PROGRAM (74) and selects a job number to program (required so that the job can be identified for future use). The product length (lockout value) is requested. The master CPU prompts for information for each of the installed slaves. This information includes start position and run length as well as data for on/off sequencing within the run length and stitch options during the on periods (the stitch allows timed or length operation for spotting purposes). When all information is entered, the operator presses RUN (70) to download the data to the slaves and being operation. Changes can be made on the fly. When all changes are entered at the master CPU, the RUN key downloads the new data. The slaves save this data in a different memory area so that the changes will not affect a piece of product in mid-run. Only when a new piece enters the operation area will the new data be used. TEST (66) can be used to evaluate a job without the counters operating. When RUN is pressed, the lob and batch counters are activated (counter information is accessed via the OPTIONS key). The SHIFT key is used to access additional functions such as units of measurement, insertion or deletion of commands, to fine tune adjustments for setting up compensation times and sensor lead distances (since these may vary slightly from one device to another due to manufacturing and installation techniques). Some of the control keys shown on the unit in FIG. 5 relate to general operation of a production line and not to the method and system of the invention.

Although the invention has been described in terms of one preferred embodiment relative to applying glue to sheets of paper, the invention applies much more broadly, as noted above, and can be used on other production lines where a workpiece or product is moved along on a conveyor, for one or more operations to be placed at desired locations on the product, those operations being subject to a lag time or compensation time for cycling of the operation "on" and "off".

The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

I claim:

1. In a process wherein products are conveyed on a conveyor and one or more operations by operating devices occurs along the path of the conveyor, such operations each having a duration and being turned "on" and "off", i.e. started and stopped by electrical pulses to the operating devices, such operations occurring on each of a series of moving products under the control of the electrical pulses as the products pass by the operating devices, and in which the operating devices have compensation times for "on" and "off" cycling, so that the speed of movement of the product, i.e. the conveyor speed, will affect the locations on the product at which the operation actually starts and stops, a method for achieving better accuracy in the positioning of these operations on the products, comprising:

storing in the computer information identifying desired positions on the products where the operations are to be located, including begin points and end points for the operations on the products, storing in the computer known compensation times for each of the operating devices positioned along the path of the conveyor in the process, detecting the position of each product as it moves along on the conveyor at least at one location in advance of the operating device, using a product sensor connected to the computer, prestoring in the computer a distance between the product sensor and an operating device, from the position of the product as noted with the product sensor, monitoring the position of the product and keeping track in the computer of the location of the product as it moves with the conveyor, with the computer, performing calculations in advance of each product's reaching the operating device, including calculating "on" and "off" compensation distances for the operating device equal to the known and prestored device "on" and "off" compensation times multiplied by current speed of movement of the conveyor as determined by the computer, and calculating a first "on" action position or pulsing position by subtracting the calculated "on" compensation distance from the position of the operating device and taking into account the desired begin point for the operations on the product, which is stored in the computer, and calculating an "off" action position by subtracting the calculated "off" compensation distance from the position of the operating device and taking into account the desired and stored end point for the operation on the product, performing said calculations just before the product reaches the operating device, so that conveyor speed information is essentially current for the calculations, in the event of occasional changes in the speed of movement of the conveyor, with the computer, sending an electrical pulse to the operating device to initiate an "on" cycle of the device when the product reaches said first "on" action position, and discontinuing said electrical pulse to the operating device to effect termination of the "on" cycle of the device, when the product reaches said first "off" action position.

2. The method of claim 1, including initiating said calculations at a position before the operating device which is based on the current speed and a known, prestored time required to make the calculations.

3. The method of claim 1, including repeatedly making conveyor speed computations with the computer as the conveyor carries the product from the product sensor toward the operating device and repeatedly pre-computing an advance distance at which said calculations should be made in advance of the operating device, by multiplying conveyor speed times the sum of a prestored compensation time for the operating device and a known time duration for performing said calculations in the computer, and multiplying the resulting multiplication product by a prestored safety factor, and including beginning said calculations just before the product reaches a point represented by said advance distance in front of the operating device.

4. The method of claim 3, including repeating the pre-computing step until such a position, as determined in the computer, that a further repetition of the pre-computing step cannot be completed before the advance distance is reached.

5. The method of claim 1, wherein the step of monitoring the position of the product and keeping track of the location of the product as it moves with the conveyor comprises tracking movement of the conveyor with an encoder monitoring conveyor movement and continually feeding a signal to the computer indicating position of the conveyor via the encoder, and wherein the speed of movement of the conveyor is determined in the computer by calculating distance moved as indicated by the encoder over an increment of time.

6. The method of claim 1, wherein the step of detecting the position of each product using a product sensor comprises sensing the leading edge of each product as it passes the product sensor.

7. The method of claim 1, wherein the process includes performing a plurality of operations by an operating device on each product, and including, after the first "on" action position has been reached by the product and the action has been taken, but before the first "off" action position has been reached, calculating a second "on" action position using said "on" compensation distance already calculated.

8. The method of claim 1, wherein the products are sheets of paper.

9. The method of claim 8, wherein the operating devices are glue heads which apply glue to the paper as it progresses by the glue head.

10. The method of claim 8, wherein the operating devices are paper slitters which operate to form a slit in the paper as it progresses on the conveyor by the slitter.

11. The method of claim 8, wherein the operating devices are paper perforators, which form perforations in the paper as it progresses on the conveyor past the perforator.

12. The method of claim 1, wherein the operating devices are glue heads which apply glue to the products as they progress by the glue heads, and including determining via the computer whether a glue head has been "off" for a preselected time duration which would indicate the glue head may not open in a normal, predictable way when pulsed, and if such preselected time duration has occurred, sending via the computer a pre-pulse to the glue head, of a short duration not sufficient to cause glue to be dispensed, said pre-pulse to be completed prior to the product's reaching the first "on" action position.

13. In a process wherein products are conveyed on a conveyor and one or more operations by operating devices occurs along the path of the conveyor, such operations being turned "on", i.e. started, by an electrical pulse to the operating device, such operations occurring on each of a series of moving products under the control of the electrical pulses as the products pass by the operating devices, and in which the operating devices have compensation times for "on" cycling, so that the speed of movement of the product, i.e. the conveyor speed, will affect the location on the product at which the operation actually starts, a method for achieving better accuracy in the positioning of these operations on the products, comprising:

storing in the computer information identifying desired positions on the products where the operations are to be located, including a begin point for each operation on the products, storing in the computer known compensation times for each of the operating devices positioned along the path of the conveyor in the process, detecting the position of each product as it moves along on the conveyor at least at one location in advance of the operating device, using a product sensor connected to the computer, prestoring in the computer a distance between the product sensor and an operating device, from the position of the product as noted with the product sensor, monitoring the position of the product and keeping track in the computer of the location of the product as it moves with the conveyor, with the computer, performing calculations in advance of each product's reaching the operating device, including calculating at least an "on" compensation distance for the operating device equal to the known and prestored device "on" compensation time multiplied by current speed of movement of the conveyor as determined by the computer, and calculating a first "on" action position or pulsing position by subtracting the calculated "on" compensation distance from the position of the operating device and taking into account the desired begin point for the operation on the product, which is stored in the computer, performing said calculations just before the product reaches the operating device, so that conveyor speed information is essentially current for the calculations, in the event of occasional changes in the speed of movement of the conveyor, with the computer, sending an electrical pulse to the operating device to initiate an "on" cycle of the device when the product reaches said first "on" action position.

14. In a process for applying glue to paper as it is moved along on a conveyor using a glue dispenser which is turned "on", i.e. started, by an electrical pulse to the operating device, such glue application occurring on each of a series of moving sheets of paper under the control of the electrical pulses as the sheets of paper pass by the glue dispenser, and in which the glue dispenser has a compensation time for "on" cycling, so that the speed of movement of the paper, i.e. the conveyor speed, will affect the location on the paper at which the operation actually starts, a method for achieving better accuracy in the positioning of the glue application on the paper sheets, comprising:

storing in the computer information identifying desired positions on the sheets of paper where the glue applications are to be located, including a begin point for each glue application on the paper sheets, storing in the computer a known compensation time for each glue dispenser positioned along the path of the conveyor in the process, detecting the position of each sheet of paper as it moves along on the conveyor at least at one location in advance of a glue dispenser, using a paper sheet sensor connected to the computer, prestoring in the computer a distance between the paper sheet sensor and the glue dispenser, from the position of the paper as noted with the paper sheet sensor, monitoring the position of the paper sheet and keeping track in the computer of the location of the paper sheet as it moves with the conveyor, with the computer, performing calculations in advance of each paper sheet's reaching the glue dispenser, including calculating at least an "on" compensation distance for the glue dispenser equal to the known and prestored glue dispenser "on" compensation time multiplied by current speed of movement of the conveyor as determined by the computer, and calculating a first "on" action position or pulsing position by subtracting the calculated "on" compensation distance from the position of the glue dispenser and taking into account the desired begin point for the glue application on the paper, which is stored in the computer, performing said calculations just before the paper reaches the glue dispenser, so that conveyor speed information is essentially current for the calculations, in the event of occasional changes in the speed of movement of the conveyor, with the computer, sending an electrical pulse to the glue dispenser to initiate an "on" cycle of the glue dispenser when the paper reaches said first "on" action position.

* * * * *